US005947451A

United States Patent [19]

Cavanagh

[11] Patent Number: 5,947,451

[45] Date of Patent: Sep. 7, 1999

[54] MARINE WINCH DRUM

[76] Inventor: Paul D. Cavanagh, 254 Middle Rd., Byfield, Mass. 01922

[21] Appl. No.: 08/915,258

[22] Filed: Aug. 20, 1997

[51] Int. Cl.[6] ..... B66D 1/00

[52] U.S. Cl. ..... 254/374; 242/613.2; 254/371

[58] Field of Search ..... 254/374, 371; 242/407, 613.2

[56] References Cited

U.S. PATENT DOCUMENTS

| | | | |
|---|---|---|---|
| 1,766,416 | 7/1930 | Clinton | 242/613.2 |
| 3,302,932 | 2/1967 | Wallin | 254/371 |
| 4,402,488 | 9/1983 | Berkovitz | 254/371 |
| 4,688,675 | 8/1987 | Guangorena | 254/374 |
| 5,314,166 | 5/1994 | Muir | 254/371 |
| 5,593,140 | 1/1997 | Van Beers | 254/374 |

FOREIGN PATENT DOCUMENTS

| | | | |
|---|---|---|---|
| 94/06710 | 3/1994 | WIPO | 254/371 |

*Primary Examiner*—John M. Jillions
*Attorney, Agent, or Firm*—Don Halgren

[57] ABSTRACT

The present invention comprises an improved marine winch drum having a plurality of grooves of a specific geometry formed in the spool of the drum to increase the holding power of the drum with respect to the line received thereon and to minimize damage to the line wrapped around the drum.

11 Claims, 2 Drawing Sheets

MARINE WINCH DRUM

BACKGROUND OF THE INVENTION

1. Field of the Invention

The present invention relates broadly to marine winches, particularly sailing winches, and is more specifically concerned with a marine winch drum of novel and beneficial conformation.

2. Prior Art

In the field of marine winches, such as those conventionally used to adjust the fabric lines or halyards of sailing craft, the winch broadly comprises a base element mounted at an appropriate locations on the mast deck or surface structure of the craft and journalled thereto, a vertically or horizontally oriented drum which may be manually, electrically or hydraulically operated through a gear train acting upon the drum. In many instances the gear train is of the reduction gear type and comprises a number of output speeds or mechanical advantages which are selected by the user through the agency of a shift mechanism.

One of the problems encountered in winches of the prior art is slippage of the line on the winch drum relative to the wraps of line placed thereon. Thus, purchase of the spool of the drum on the lines has been deficient, thereby often requiring multiple adjacent wraps of the line upon the spool to achieve a given holding power. Thus, not only are multiple wraps of line usually required to be received onto the spool to handle the sailing line load, but also considerable line abrasion can occur between adjacent line wraps as the wraps slip relative to the drum and to one another, thereby reducing the service life of the line. The problem of line abrasion can be particularly acute where the lines employed are constructed of synthetic fibers, such as polyester or nylon, or where the lines are equipped with an external sheath, such as is common in modern marine cordage. Indeed, in yacht racing where trimming of sails is a nearly continuous requirement and line loads tend to be maximized, there are many known occasions wherein line abrasion due to winch operations has required line replacement after each race.

The foregoing problems have been previously recognized and addressed by the prior art with only modest success. For instance, sailing winch drums have been produced whose spool portions are provided with a plurality of spaced apart relatively deep flutes coaligned with the longitudinal axis of the drum. Also, marine winch drum spools having a rough surface texture, such as producible by abrasive blasting or etching of the spool surface, are known. Indeed, even coating of a drum spool with a coarse ceramic material has been attempted. None of these techniques, however, provides a permanent solution to these problems. The fluting technique mentioned tends to yield too much of an increase in line holding power and has little effect on the problem of wrap to wrap chafing of the line. Providing the drum spool with a rough surface texture or coating the spool with a coarse ceramic tends to provide only temporary improvements in drum performance because, during the course of use of the winch, these approaches tend to wear away or spall from the spool surface. In accordance with the present invention, however, the foregoing problems have been successfully addressed.

OBJECTS OF THE INVENTION

It is the principal object of the invention to provide a novel marine winch drum.

It is another object of the invention to provide a marine winch drum exhibiting improved line holding power.

It is another object of the invention to provide a marine winch drum wherein wrap to wrap chafing of the line received thereon is reduced.

It is still another object of the invention to provide a marine winch drum wherein wrap to wrap contact of the line received thereon contributes to the overall line holding power of the drum.

Other objects and advantages of the present invention will in part be obvious and will in part appear hereinafter.

BRIEF SUMMARY OF THE INVENTION

In accordance with the present invention there is provided a novel marine winch drum conformation comprising multiple spaced apart, shallow, V-shaped or U-shaped grooves spanning a portion of the length of the drum spool and which multiple grooves serve to not only improve the purchase of the drum spool upon the line received thereon, but cause each succeeding wrap of line contained on the spool to bear against its predecessor wrap in a functional and beneficial manner. The grooves are directed generally downwardly (generally axially) from the top of the spool and each groove decreases progressively in width and depth from the top to bottom thereof. The grooves terminate preferably at least one line diameter above the bottom of the spool. In a preferred embodiment of the invention the grooves are helically directed about the spool in the direction of rotation of the drum. The spool decreases in diameter from its upper end to its lower end, preferable over only the extent of the irregularities, such as the grooves. Such a taper of the spool may lie in a range of for example, of about 2° to about 10° with respect the axis of rotation of the drum.

The invention thus comprises an improved winch for the controlled winding and unwinding of line wrapped therearound, including a generally cylindrically shaped spool element having a first and a second end and a longitudinal axis about which the spool revolves and a first or upper flange and a second or bottom flange secured to the respective ends of the drum or spool element. The spool element is somewhat irregular, which irregularity includes being preferably tapered, and also comprises a plurality of spaced apart, shallow, U or V-shaped grooves disposed about the circumference thereof. The grooves extend downwardly from a first end of the spool element and terminate at a distance of at least one line diameter from a second end thereof, each of the grooves progressively decreasing in depth and width from the first end to the other end thereof. The grooves in a first preferred embodiment may be disposed in a slight helical orientation with respect to the longitudinal axis of the drum. The grooves in another preferred embodiment may be straight and oriented parallel with respect to the longitudinal axis of the spool element. The drum has a particular direction of rotation and the grooves are helically oriented in the direction of the rotation. The grooves at the second end of the drum trail the grooves at the first end thereof in respect of the direction of rotation. The drum may be arranged as part of a marine sailing winch for trimming sails of a sailboat, a hoist or the like, in other embodiments.

The invention also includes a method of trimming a line about a drum of a winch to ensure good purchase of the line on the winch, comprising the steps of wrapping a first length of line about an annular surface of the drum during one revolution of the drum of the winch; and wrapping a second length of line about the annular surface of the drum during a second revolution of the drum of the winch, the second and succesive lengths of line being equal with respect to the first length of line, for successive equal revolutions of the drum. The method includes the step of providing the annular surface of the drum with grooves therealong, in general alignment with its axis of revolution, the grooves having a first end and a second end. The first end of the grooves being wider and deeper than at the second end of the grooves. The method includes providing a generally drum shaped, axially rotatable spool on which the line may be disposed; and forming a plurality of elongated grooves of diminishing dimensions from one end thereof to the other end thereof on the other annular surface of the spool to permit a good purchase thereagainst of any line wrapped therearound. The method includes the steps of tapering the drum shaped spool to an angle in a range of about 2° to about 10° to ensure that the length of line wrapped about one end of the spool during one revolution thereof is equal to the length of line wrapped about the other end of the spool during one revolution thereof, tapering the width of the grooves from a wide portion having a range for example of about 0.25 inches to about 0.75 inches at an upper or first end thereof, tapering to a narrower dimension at a lower or second thereof; tapering the depth of the grooves from a deepest portion at an upper or first end thereof of a depth of a range of about 0.5 inches to about 0.25 inches at its deepest end, to a shallower dimension (ultimately to zero width and depth) at a lower or second thereof; and curving the grooves from an upper or first end thereof, to a lower or second thereof, in a helical manner.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
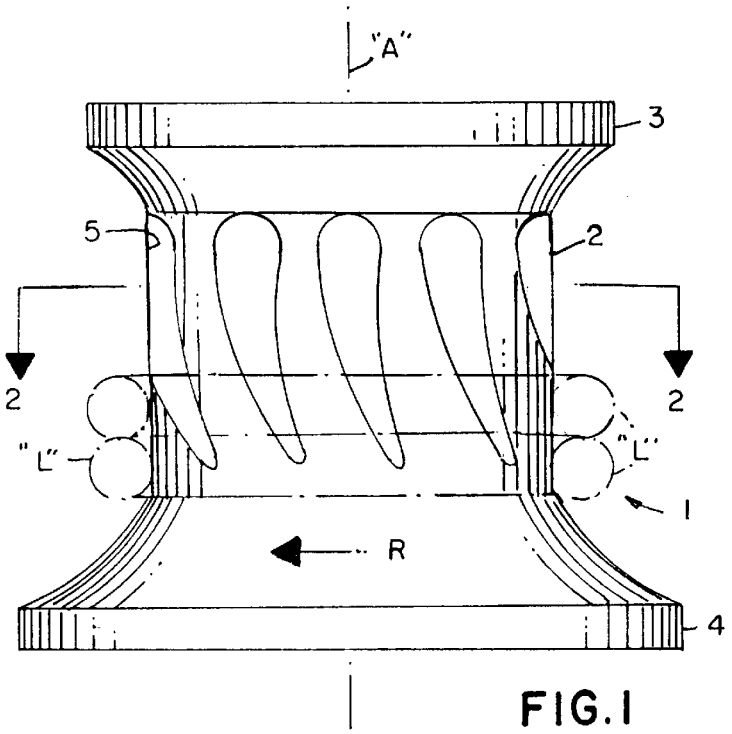
FIG. 1 is a side view of a representative winch drum in accordance with the present invention.
Figure 2:
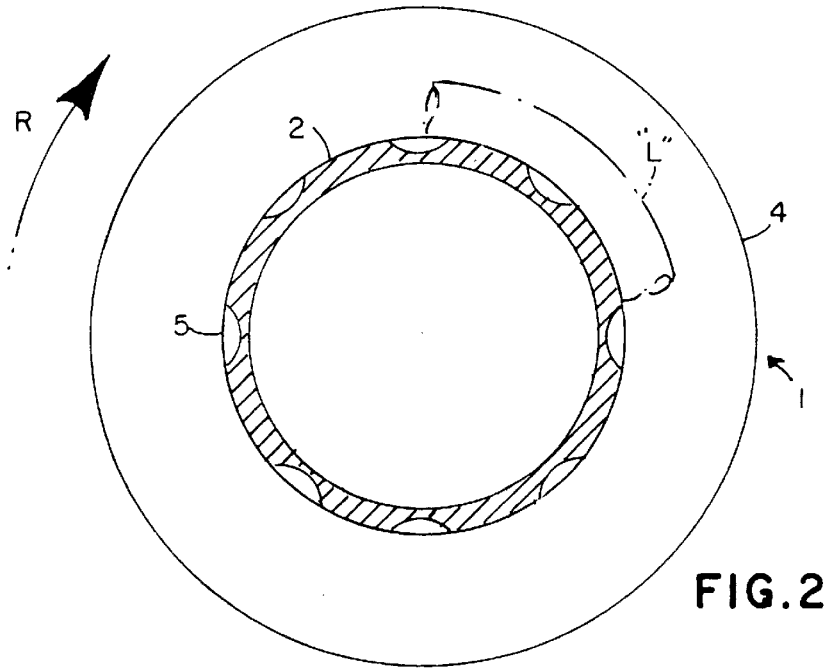
FIG. 2 is a top sectional view of the winch drum of FIG. 1, taken through lines 2—2 thereof.

Referring now to the drawings in detail, and particularly to FIGS. 1 and 2, there is shown a representative marine winch drum 1 comprising a spool element 2, an upper flange 3 and a bottom flange 4, with a longitudinal axis of rotation "A". In accordance with the invention the spool element 2 is provided with a plurality of spaced apart, shallow, U or V-shaped grooves 5 disposed about its circumference. The grooves 5 extend downwardly from the top of the spool element 2 and terminate at a spaced distance from the bottom thereof. Since marine winch drums and the spools thereof are conventionally cast, the grooves 5 may be produced during the original casting of the spool in a mold or, conveniently, may be milled into an already formed spool using appropriately configured cutters. The spaced minimum distance between the bottom of the spool and the bottom ends of the grooves 5 may be subject to variation and is dictated by the diameter of a line "L", shown in phantom in FIG. 1, to be received on the spool element 2. In general, the spaced distance should, at the minimum, be such that the first wrap of line received onto the bottom of the spool element 2 avoids engagement with the grooves 5 while succeeding wraps are progressively engaged by the grooves 5. As may be seen in FIG. 1, the depth and width of the grooves 5 decrease progressively from top to bottom. The bottom ends of the grooves 5 are the shallowest and narrowest while the top ends thereof are the deepest and widest.

Thus, as succeeding line wraps are received upwardly onto the spool element 5, the line wraps engage ever widening and deepening grooves 5, thereby providing progressively greater purchase of the spool element 2 on said succeeding line wraps. Note the length of line required to make successive circumferential wraps of the drum from the one (lower) end to the other (upper) end of the drum is the same each time, because, as the chord formed at such locations subtending each arc of the groove 5, gets longer thereby reducing the amount of line normally wrapping the arc over the grooves 5 of the drum, the diameter of the spool 2 itself increases in the direction from the bottom of the spool 2 to its upper end, the small taper not specifically shown in the figures, for clarity. Such a taper of the spool 2, extending preferably only along the area of the grooves, may fall in a range of about 2° to about 10°, which taper may be dependent on factors such as the diameter of the line "L" (rope) being utilized on the spool 2, the number of grooves 5 and the width of those grooves 5 on the spool 2.

Figure 3:
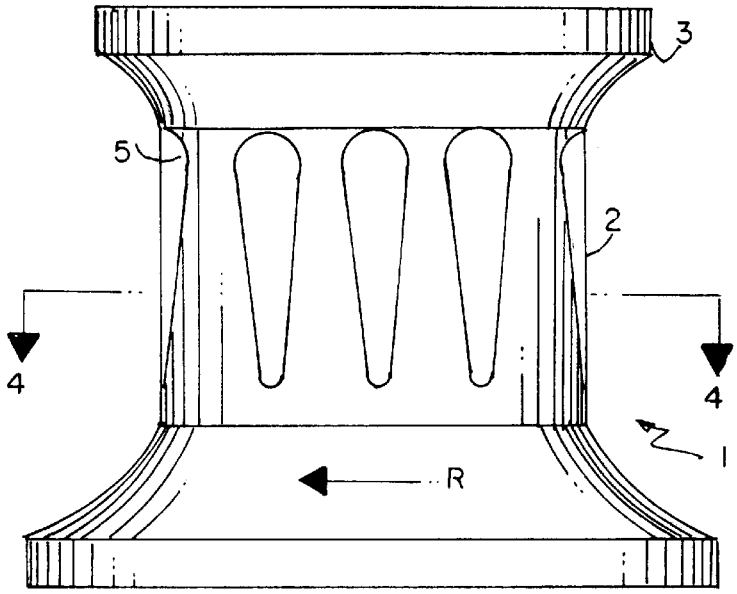
FIG. 3 is a side view of a further embodiment of the winch drum of the present invention.
Figure 4:
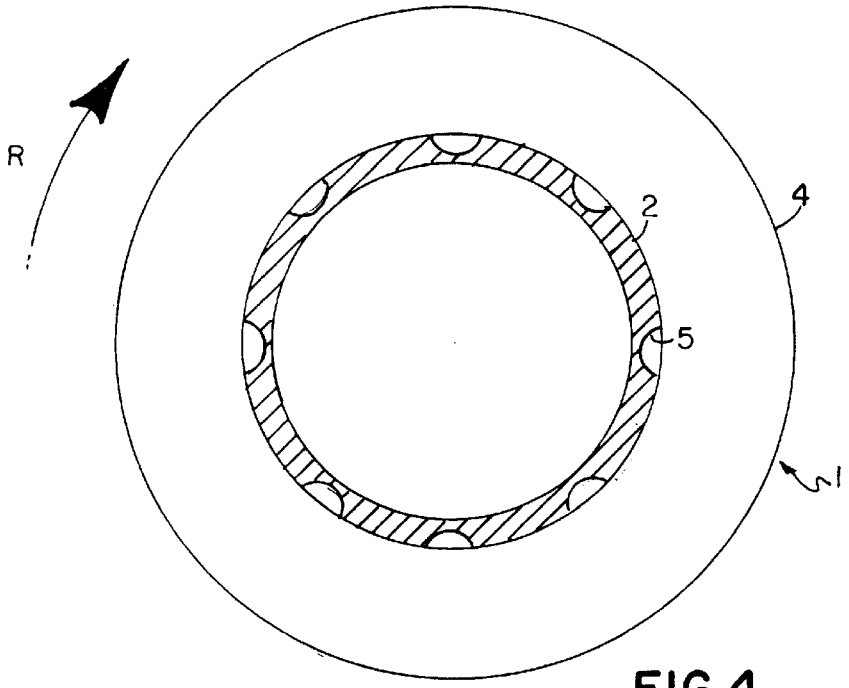
FIG. 4 is a sectional view of the winch drum taken along the lines 4—4 of FIG. 3.

While the grooves 5 in one preferred embodiment may be straight and oriented parallel to the longitudinal center line "A" of the spool element 2, as shown in FIGS. 3 and 4, in another embodiment shown in FIGS. 1 and 2, they may be configured helically. It is also preferred that said helical configuration be oriented in the direction of rotation "R", of the drum 1, that is to say, that the bottom of the grooves 5 trail the tops thereof with respect to the direction of rotation of the drum 1. Utilizing a winch equipped with the drum of the invention, the grooves 5 serve to engage the second and successive wraps of line received onto the spool 2 and, particularly in the preferred helical configuration thereof, to progressively urge the wraps more tightly together as successive wraps are received onto the spool. This action progressively increases friction as between the wraps, thereby reducing chafing between adjacent wraps and increasing line life. Additionally, this increasing wrap to wrap binding enlists the wraps themselves as contributors to the overall line holding power of the drum. Thus, with respect to known drums of the prior art, the drum of the invention tends to achieve a given line pull with a lesser number of line wraps therearound. This is advantageous in that it can substantially reduce the work load on the mariner in trimming sails.

While the foregoing description and appended drawings illustrate certain embodiments and techniques for implementation and use of the present invention it should be recognized and understood that the description and drawings are illustrative in nature and are not to be construed as limiting of the invention. Many changes, modifications and variations may be made in the above description and drawings without departing from the essential scope, spirit or intention of the invention, as will be obvious to those of skill in the art. For instance, while the invention has been specifically described with respect to a marine sailing winch for the trimming of sails, the invention may also find beneficial application in other marine winch applications such as, for instance, in capstans for hauling hawsers and the like. Also, while the invention has been specifically described in respect of winches wherein the drums thereof are vertically oriented, the invention may also find beneficial application in those marine winches, such as windlasses, wherein the drums are horizontally oriented. In this last case the free end of the windlass drum is to be construed as the top while that end of the drum affixed to the driving mechanism therefore is to be construed as the bottom thereof. Accordingly, the invention is intended to be limited only by reference to the appended claims.

I claim:

1. An improved winch for the controlled winding and unwinding of line wrapped therearound, comprising:

a cylindrically shaped spool element having a first and a second end and a longitudinal axis about which said spool revolves;

said spool element comprising a plurality of spaced apart, shallow, U or V-shaped grooves disposed about the circumference thereof; and said grooves extending from said first end of said spool element towards said second end thereof, each of said grooves being disposed in a helical orientation with respect to said longitudinal axis of said spool.

2. The improved winch as recited in claim 1, including a first or upper flange and a second or bottom flange secured to the respective ends of said spool element to provide end components thereto.

3. The improved winch as recited in claim 1, wherein said spool has a tapered surface with respect to said longitudinal axis thereof.

4. The improved winch as recited in claim 3, wherein said tapered surface is tapered within a range of about 2° to about 10° with respect to said longitudinal axis of said spool, said taper extending along the extent of said grooves.

5. The improved winch as recited in claim 1 wherein said spool has a particular direction of rotation and said grooves are helically oriented in the direction of said rotation, said grooves at said second end of said spool trailing said grooves at said first end thereof in respect of said direction of rotation.

6. The improved winch as recited in claim 1 wherein said spool is arranged as part of a marine sailing winch for trimming sails of a sailboat.

7. A method of trimming a line about a drum of a winch to ensure good purchase of said line on said winch, comprising the steps of:

wrapping an initial length of line about an irregular generally annular surface of said drum during one revolution of said drum of said winch;

wrapping a further length of line about said irregular annular surface of said drum during a further revolution of said drum of said winch, said further length of line being equal with respect to said initial length of line, for equal revolutions of said drum; and providing said annular surface of said drum with helically arranged grooves therealong, in general alignment with its axis of revolution, said grooves having a first end and a second end, said first end of said grooves being wider and deeper than at said second end of said grooves.

8. A method of manufacturing a winch for the wrapping and tightening of a line thereabout, comprising the steps of:

providing a generally drum shaped, axially rotatable spool on which said line may be disposed; and forming a plurality of helically disposed elongated grooves of diminishing dimensions from one end thereof to the other end thereof on the outer annular surface of said spool to permit a good purchase thereagainst of any line wrapped therearound.

9. The method of manufacturing a winch for the wrapping and tightening of a line thereabout, as recited in claim 8, including the step of:

tapering said drum shaped spool to an angle in a range of about 2° to about 10° to ensure that the length of line wrapped about one end of said spool during one revolution thereof is equal to the length of line wrapped about the other end of said spool during one revolution thereof.

10. The method of manufacturing a winch for the wrapping and tightening of a line thereabout, as recited in claim 8, including the step of:

tapering the width of said grooves from a wide portion at an upper or first end thereof, to a narrower dimension at a lower or second thereof.

11. The method of manufacturing a winch for the wrapping and tightening of a line thereabout, as recited in claim 8, including the step of:

tapering the depth of said grooves from a deepest portion at an upper or first end thereof, to a shallower dimension at a lower or second thereof.

* * * * *